US008923096B1

(12) United States Patent
Stotz et al.

(10) Patent No.: US 8,923,096 B1
(45) Date of Patent: Dec. 30, 2014

(54) METHOD OF DISPLAYING ELAPSED TIME ON A WRISTWORN DEVICE AND WRISTWORN DEVICE DISPLAYING SAME

(71) Applicant: Timex Group USA, Inc., Middlebury, CT (US)

(72) Inventors: Gerhard Stotz, Eisingen (DE); Louis M. Galie, Leander, TX (US)

(73) Assignee: Timex Group USA, Inc., Middlebury, CT (US)

( * ) Notice: Subject to any disclaimer, the term of this patent is extended or adjusted under 35 U.S.C. 154(b) by 0 days.

(21) Appl. No.: 14/056,234

(22) Filed: Oct. 17, 2013

(51) Int. Cl.
*G04F 8/00* (2006.01)
*G04B 19/04* (2006.01)

(52) U.S. Cl.
CPC ..... *G04F 8/006* (2013.01); *G04B 19/048* (2013.01)
USPC ..... 368/110; 368/112

(58) Field of Classification Search
CPC ..... G04F 8/006; G04B 19/048
USPC ..... 368/110, 112, 113
See application file for complete search history.

(56) References Cited

U.S. PATENT DOCUMENTS

| | | | | |
|---|---|---|---|---|
| 4,364,669 | A * | 12/1982 | Thoenig et al. | 368/111 |
| 4,389,122 | A * | 6/1983 | Dubois et al. | 368/110 |
| 5,122,995 | A | 6/1992 | Vuilleumier | |
| 5,959,941 | A * | 9/1999 | Murakami et al. | 368/80 |
| 6,570,823 | B1 * | 5/2003 | Gilomen et al. | 368/113 |
| 6,842,403 | B2 | 1/2005 | Meis | |
| 7,130,247 | B2 | 10/2006 | Brida et al. | |
| 7,445,374 | B2 | 11/2008 | Forsey et al. | |
| 8,432,772 | B2 | 4/2013 | Meis | |
| 8,737,175 | B2 * | 5/2014 | Bakker | 368/80 |
| 2001/0043512 | A1 * | 11/2001 | Igarashi et al. | 368/204 |

* cited by examiner

*Primary Examiner* — Vit W Miska
(74) *Attorney, Agent, or Firm* — Carmody Torrance Sandak & Hennessey LLP

(57) ABSTRACT

Methodologies and constructions of displaying elapsed time on a wristworn device, which include among other things, having at least two display hands one of which that will rotate faster or stop so that they become coincident with each other, then rotate together and then reassume their normal and accurate positions. Such is particularly important with respect to one of the hands that is preferably a seconds hand that might otherwise be displaying seconds of the time of day ("TOD").

8 Claims, 7 Drawing Sheets

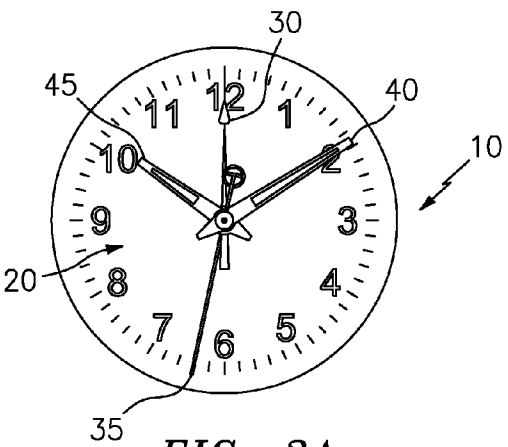
FIG. 2A
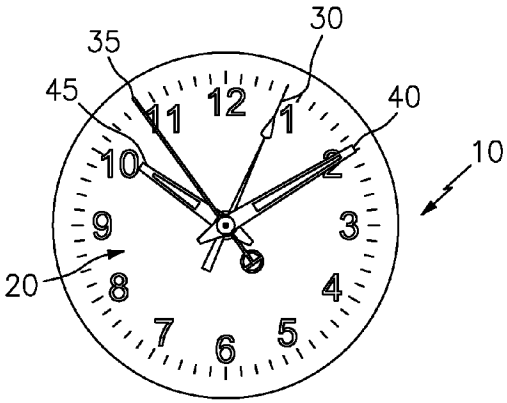
FIG. 2B
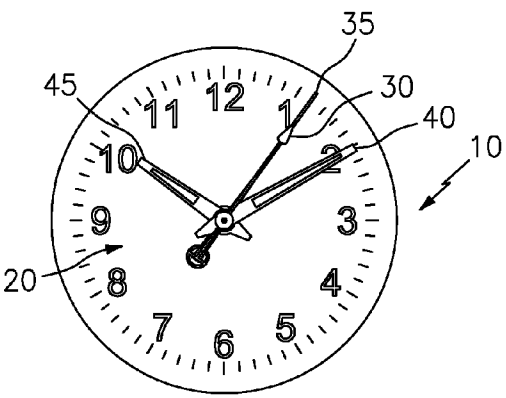
FIG. 2C
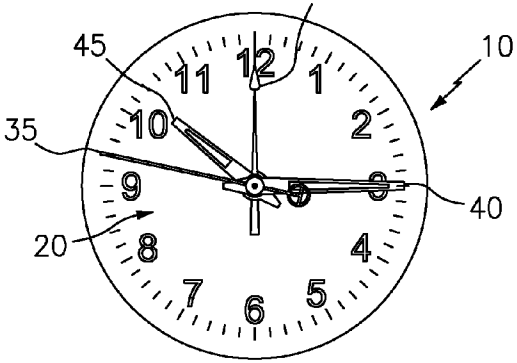
FIG. 2D
FIG. 2E
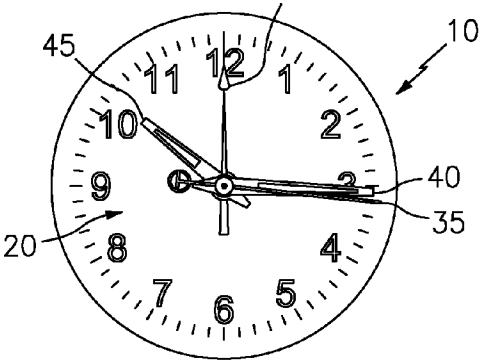
FIG. 2F

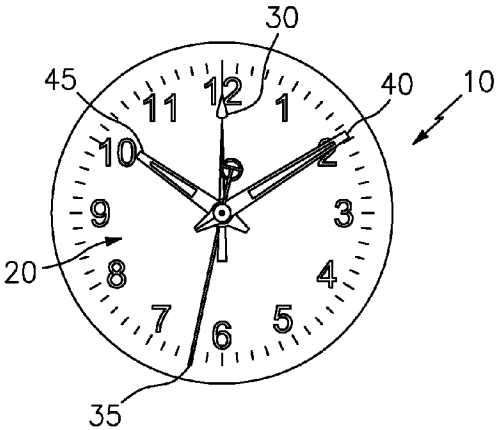
FIG. 3A
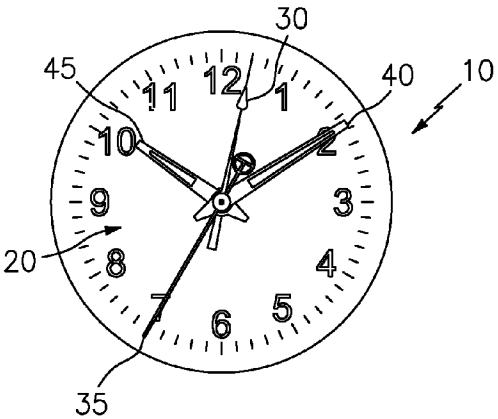
FIG. 3B
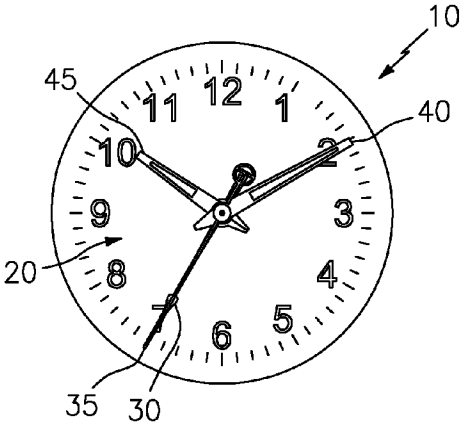
FIG. 3C
FIG. 3D
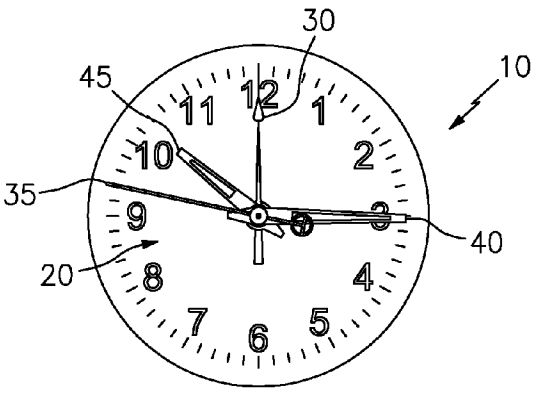
FIG. 3E
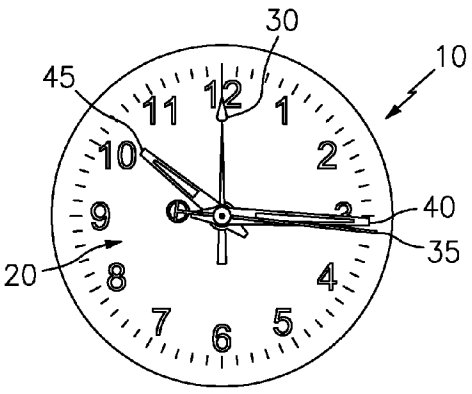
FIG. 3F

METHOD OF DISPLAYING ELAPSED TIME ON A WRISTWORN DEVICE AND WRISTWORN DEVICE DISPLAYING SAME

BACKGROUND OF THE INVENTION

The present invention is directed generally to constructions and methodologies for facilitating the reading of elapsed time on a display, and in particular, the invention is directed to constructions of a wristworn device, such as a chronograph watch by way of example and not limitation, and methodologies for the display and reading of elapsed time when there is more than one rotatable display hand. Among other things, the present invention reduces possible confusion and errors in reading and displaying of elapsed time on a display when there is more than one display hand that can be rotating about the display.

Timepieces that have more than one rotatable hand, which in their respective normal operation show (e.g.) elapsing time in seconds or otherwise, are known. One well known timepiece that has both a "center-mounted" seconds hand for displaying elapsing time of day (TOD) seconds and (e.g.) a large center-hand that can also display elapsing seconds (e.g. "chrono seconds") is a chronograph watch.

Thus, in such conventional watches, when the large center-hand for displaying the "chrono seconds" (hereinafter for convenience and not limitation, the "chrono hand") is started and running (e.g. rotating), the chrono hand and the TOD "seconds hand" may both be rotating at the same rate such that they maintain a certain angle between them. Therefore, and depending on the design (e.g. shape and size) of the seconds hands and/or the chrono hand, it may be less than obvious for a user to differentiate between the chrono hand and the seconds hand. This can lead to misinterpretation and/or confusion when reading the displayed chrono seconds (e.g. the elapsed "chrono time") and/or the TOD seconds.

The prior art describes examples of overlapping hands. For example, U.S. Pat. Nos. 5,122,995; 6,842,403; 7,130,247; 7,445,374 and 8,432,772 describe examples of known references that provide for the overlapping of hands in a timepiece.

However, further improvements to the state of the art are desirable and achievable. For example, it is believed that constructions and associated methodologies in which there is an acceleration and/or stopping of the seconds hand after the initiation of the chrono hand and thereafter (e.g. after stopping of the chrono hand), an either further acceleration or stopping of the seconds hand until the seconds hand is in the correct and "true up" position will still further reduce the likelihood of misinterpretation, error and/or confusion in reading and interpreting elapsed time on a wristworn device, such as a timepiece. Accordingly, such constructions and methodologies for such improved wristworn devices, such as timepieces, are set forth herein in accordance with the present invention.

SUMMARY AND OBJECTIVES OF THE INVENTION

It is thus an objective of the present invention to overcome the perceived deficiencies in the prior art.

For example, it is an objective of the present invention to provide a wristworn device that reduces the likelihood of misinterpretation, error and/or confusion in reading and interpreting elapsed time on a wristworn device, such as a timepiece.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

Therefore, and generally speaking, in accordance with a first preferred embodiment, the invention is directed to a method of displaying elapsed time on a display of a wristworn device, wherein the wristworn device comprises said display, at least one rotatable display hand for displaying elapsed time, a rotatable seconds hand for displaying elapsed time related to the time of day (TOD), and wherein rotation of the at least one display hand can be initiated and terminated, and wherein during a first mode the seconds hand is rotating about the display at a first rate, the method comprises the steps of starting the rotation of the at least one display hand; stopping the rotation of the seconds hand until the at least one display hand is at least essentially coincident with the seconds hand; starting the rotation of the seconds hand so that the seconds hand and the at least one display hand rotate together at the first rate and remain at least essentially coincident; stopping the rotation of the at least one display hand; and thereafter, rotating the seconds hand at a rate faster than the first rate until the seconds hand reaches a position at which the seconds hand would have been had it not been stopped; and then causing the seconds hand to rotate about the display at the first rate. In another preferred embodiment, a wristworn device for carrying out the aforementioned methodology is also provided.

In yet another preferred embodiment, the invention is related to a method of displaying elapsed time on a display of a wristworn device, wherein the wristworn device comprises said display, at least one rotatable display hand for displaying elapsed time, a rotatable seconds hand for displaying elapsed time related to the time of day (TOD), and wherein rotation of the at least one display hand can be initiated and terminated, and wherein during a first mode the seconds hand is rotating about the display at a first rate, the method comprises the steps of starting the rotation of the at least one display hand; advancing the rotation of the seconds hand at a rate faster than the first rate until the seconds hand is at least essentially coincident with the at least one display hand, and then causing the seconds hand to return to rotate about the display at the first rate; continuing the rotation of the seconds hand so that the seconds hand and the at least one display hand rotate together at the first rate and remain at least essentially coincident; stopping the rotation of the at least one display hand; and stopping the rotation of the seconds hand until the seconds hand is at a position at which the seconds hand would have been had it not advanced at the rate faster than the first rate; and then causing the seconds hand to rotate about the display at the first rate. Similarly, also provided is a wristworn device that carries out the aforementioned methodology.

In still another preferred embodiment, the invention may be directed to a wristworn device that displays elapsed time on a display, wherein the wristworn device comprises at least one rotatable display hand for displaying the elapsed time; a rotatable seconds hand for displaying elapsed seconds related to the time of day (TOD), wherein during a first mode, the seconds hand rotates about the display at a TOD seconds hand rotation rate; a switching arrangement for initiating and terminating a rotation of the at least one display hand; and a controller, operatively coupled to the switching arrangement, for initiating the rotation of the at least one display hand; stopping the rotation of the seconds hand until the at least one display hand is at least essentially coincident with the seconds hand; starting the rotation of the seconds hand so that the seconds hand and the at least one display hand rotate together at the TOD seconds hand rotation rate and remain at least essentially coincident; terminating the rotation of the at least one display hand; and thereafter, causing the rotating of the seconds hand at a rate faster than the TOD seconds hand rotation rate until the seconds hand reaches a position at which the seconds hand would have been had it not been stopped; and then causing the seconds hand to rotate about the display at the TOD seconds hand rotation rate.

And in yet another preferred embodiment, a wristworn device is also provided that displays elapsed time on a display, wherein such a wristworn device comprises at least one rotatable display hand for displaying elapsed time; a rotatable seconds hand for displaying elapsed seconds related to the time of day (TOD), wherein during a first mode, the seconds hand rotates about the display at a TOD seconds hand rotation rate; switching arrangement for initiating and terminating a rotation of the at least one display hand; and a controller, operatively coupled to the switching arrangement, for initiating the rotation of the at least one display hand; causing the rotating of the seconds hand at a rate faster than the TOD seconds hand rotation rate until the seconds hand is at least essentially coincident with the at least one display hand, and then causing the seconds hand to return to rotate about the display at the TOD seconds hand rotation rate; providing for the continued rotation of the seconds hand so that the seconds hand and the at least one display hand rotate together at the TOD seconds hand rotation rate and remain at least essentially coincident; terminating the rotation of the at least one display hand; and thereafter, stopping the rotation of the seconds hand until the seconds hand is at a position at which the seconds hand would have been had it not advanced at the rate faster than the TOD seconds hand rotation rate; and then causing the seconds hand to rotate about the display at the TOD seconds hand rotation rate.

In preferred embodiments, the wristworn device is in the form of a wristwatch, such as a chronograph by example and not limitation.

BRIEF DESCRIPTION OF THE DRAWINGS

The above set forth and other features of the invention are made more apparent in the ensuing Description of the Preferred Embodiments when read in conjunction with the attached Drawings, wherein:

FIGS. 1A, 1B, 1C, 1D and 1E each illustrate a preferred step in a collective step by step methodology of a preferred sequence in accordance with a preferred embodiment of the present invention, wherein FIG. 1A illustrates device 10 in a normal "run" mode, FIG. 1B illustrates device 10 at a moment in time approximately five (5) seconds later than that shown in FIG. 1A, with chrono hand 30 rotating and seconds hand 35 stopped, FIG. 1C illustrates chrono hand 30 having reached, and now coincident with, seconds hand 35, FIG. 1D illustrates chrono hand 30 and seconds hand 35 running together, and FIG. 1E illustrates chrono hand 30 having been reset to its "home" (e.g. 12 o'clock position) and seconds hand 35 after it has accelerated at a "rate faster than the first rate" (as disclosed herein) and is again rotating at its TOD seconds hand rotation rate;

FIGS. 2A, 2B, 2C, 2D, 2E and 2F each illustrate a preferred step in a collective step by step methodology of another preferred sequence in accordance with another preferred embodiment of the present invention, wherein FIG. 2A illustrates device 10 in a normal "run" mode, FIG. 2B illustrates device 10 with chrono hand 30 rotating and seconds hand 35 operating at a "rate faster than the first rate" (as disclosed herein), FIG. 2C illustrates seconds hand 35 having reached, and now coincident with, chrono hand 30, FIG. 2D illustrates chrono hand 30 and seconds hand 35 running together, FIG. 2E illustrates chrono hand 30 and seconds hand 35 having been running together for approximately five (5) seconds more than that shown in FIG. 2D, after which chrono hand 30 has been reset to its "home" (e.g. 12 o'clock position) and seconds hand 35 now remains in a stopped condition until seconds hand 35 is displaying the correct TOD seconds, and FIG. 2F illustrates seconds hand 35 some time after that shown in FIG. 2E and rotating at the TOD seconds hand rotation rate;

FIGS. 3A, 3B, 3C, 3D, 3E and 3F each illustrate a preferred step in a collective step by step methodology of a preferred sequence in accordance with yet another preferred embodiment of the present invention, wherein FIG. 3A illustrates device 10 in a normal "run" mode, FIG. 3B illustrates device 10 at a moment in time approximately five (5) seconds later than that shown in FIG. 3A, with chrono hand 30 rotating and seconds hand 35 stopped, FIG. 3C illustrates chrono hand 30 having reached, and now coincident with, seconds hand 35, FIG. 3D illustrates chrono hand 30 and seconds hand 35 running together, FIG. 3E illustrates chrono hand 30 and seconds hand 35 having been running together for approximately six (6) seconds more than that shown in FIG. 3D, after which chrono hand 30 has been reset to its "home" (e.g. 12 o'clock position) and seconds hand 35 remains in a stopped condition until seconds hand 35 is displaying the correct TOD seconds, and FIG. 3F illustrates seconds hand 35 some time after that shown in FIG. 3E and rotating at the TOD seconds hand rotation rate;

FIGS. 4A, 4B, 4C, 4D, 4E and 4F each illustrate a preferred step in a collective step by step methodology of still another preferred sequence in accordance with still another preferred embodiment of the present invention, wherein FIG. 4A illustrates device 10 in a normal "run" mode, FIG. 4B illustrates device 10 with chrono hand 30 rotating and seconds hand 35 operating at a "rate faster than the first rate" (as disclosed herein), FIG. 4C illustrates seconds hand 35 having reached, and now coincident with, chrono hand 30, FIG. 4D illustrates chrono hand 30 and seconds hand 35 running together, FIG. 4E illustrates chrono hand 30 having been reset to its "home" (e.g. 12 o'clock position) and seconds hand 35 rotating at a "rate faster than the first rate," and FIG. 4F illustrates seconds hand 35 some time after that shown in FIG. 2E and now rotating at the TOD seconds hand rotation rate.

Identical reference numerals in the figures are intended to indicate like parts, although not every feature in every figure may be called out with a reference numeral.

DETAILED DESCRIPTION OF THE PREFERRED EMBODIMENTS

Figure 1A:
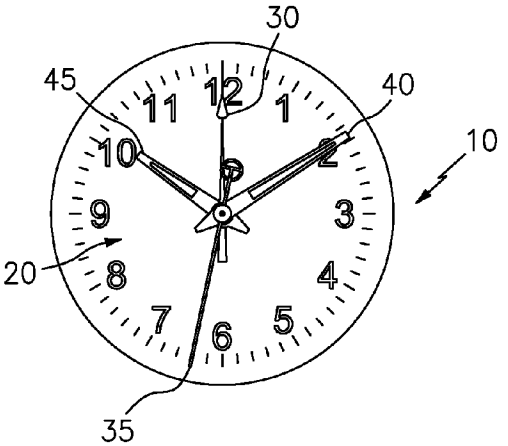
Figure 1B:
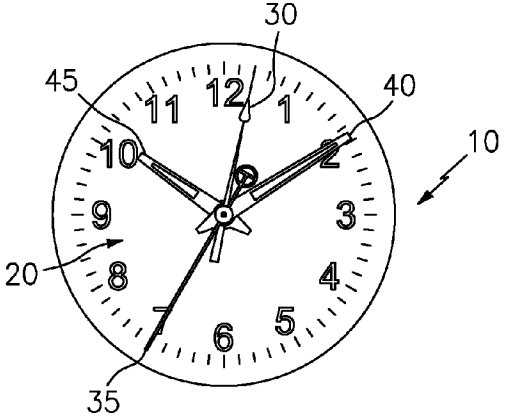
Figure 1C:
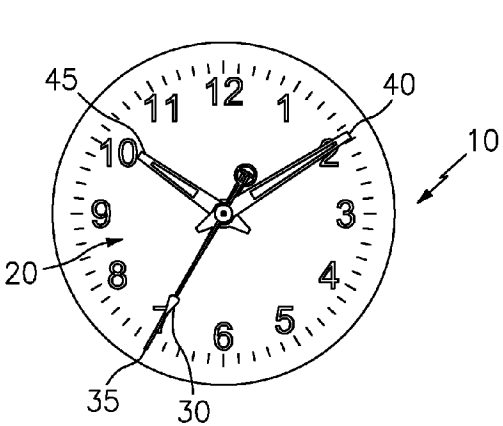
Figure 1D:
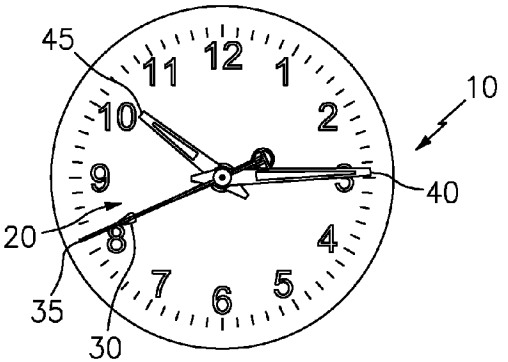
Figure 1E:
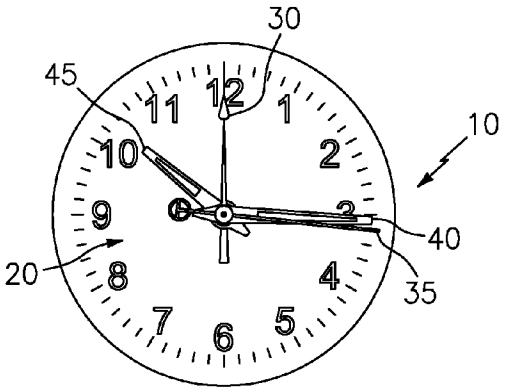

Reference will be made to FIGS. 1-7 in connection with the following text for a full disclosure of the preferred embodiments of the present invention. Generally speaking, the preferred embodiments of the present invention contemplate four (4) generally categorized methodologies, the first of which is illustrated in FIGS. 1A, 1B, 1C, 1D and 1E (collectively which may be referred to as "FIG. 1"), the second of which is illustrated in FIGS. 2A, 2B, 2C, 2D, 2E and 2F (collectively which may be referred to as "FIG. 2"), the third of which is illustrated in FIGS. 3A, 3B, 3C, 3D, 3E and 3F (collectively which may be referred to as "FIG. 3") and the fourth of which is illustrated in FIGS. 4A, 4B, 4C, 4D, 4E and 4F (collectively which may be referred to as "FIG. 4").

However, first by way of general disclosure, a wristworn device constructed in accordance with a preferred embodiment of the present invention, is generally indicated at 10, comprises a display, generally indicated at 20, which may comprise a dial (but not necessarily, as would be understood with E-ink or other LCD type displays in which a (e.g.) metal or mylar dial is not needed) and time elapsed demarcations, such as seconds. The present invention is discussed by way of example with reference to elapsing seconds, and so such seconds demarcations are both visible for ease of discussion, but as would be understood in the art, a display to display elapsing time can be done in various ways and with respect to time periods of more or less than elapsing seconds while still remaining within the scope of the present invention. For example, the display and/or elapsing of time, such as 1/10 or 1/5 seconds, or other time periods, are well within the scope of the present invention.

In accordance with the preferred embodiments of the present invention, only a first display hand and a second display hand are needed to carry out the objectives of the present invention. To denote the first display hand, reference will be made to at least one rotatable display hand 30 for displaying elapsed time. Again, in a preferred embodiment, such elapsed time is seconds, but other time periods (e.g. 1/10 or 1/5 seconds, or longer) are within the scope of the present invention. For convenience, this hand 30 may also be referred to as chrono hand 30. To denote the second display hand, reference will be made to a rotatable hand 35 for displaying elapsed time, such as seconds, related to the time of day (TOD). Here too, in a preferred embodiment, such elapsed time is seconds, but other time periods (e.g. 1/10 or 1/5 seconds or longer) are within the scope of the present invention. For convenience, this hand 35 may be referred to as seconds hand 35. Preferably, although not necessary as should be understood by those skilled in the art, in the event that wristworn device 10 is a timepiece, device 10 will preferably comprise a minute hand 40 and an hour hand 45, both of which are driven by a stepper motor and gear train, as generally discussed below.

Generally speaking, FIGS. 1 and 3 illustrate preferred methodologies in which the initiation of the chrono hand 30 also results in the stopping of seconds hand 35 until the chrono hand 30 and the seconds hand 35 coincide. Then, as long as the chrono hand 30 keeps running, the chrono hand 30 and the seconds hand 35 run together, preferably one underneath the other, so that it appears as if there is only one hand rotating (see FIGS. 1C, 1D, 3C, 3D) and displaying such elapsed time. Once the chrono hand 30 is stopped and reset, the chrono hand 30 may return to a home position (e.g. FIG. 1E, 3E), and the seconds hand 35 will either stop (see generally FIG. 3) or run at a faster rotation rate (see generally FIG. 1) until it has reached the correct position (i.e. as if it had not previously been stopped). From there it will resume running at the proper rate and displaying the proper TOD seconds (e.g. FIG. 1E, 3F).

Figure 4A:
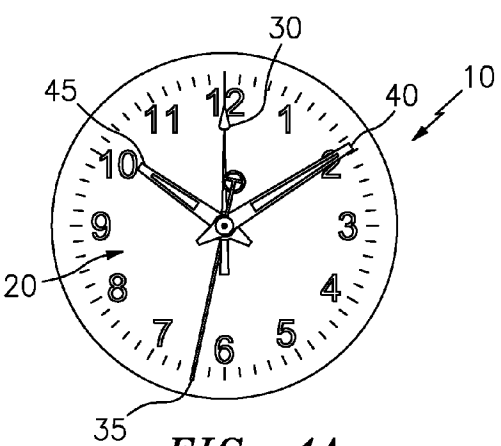
Figure 4B:
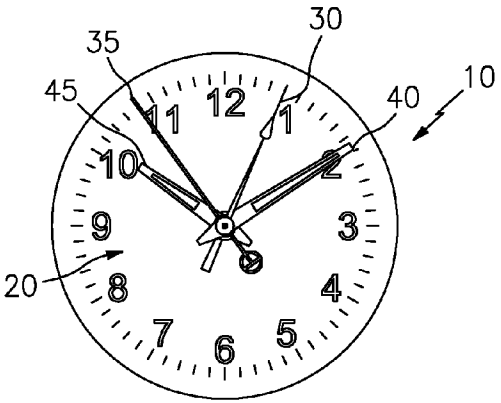
Figure 4C:
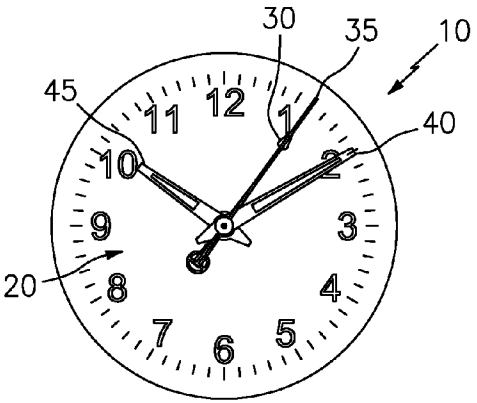
Figure 4D:
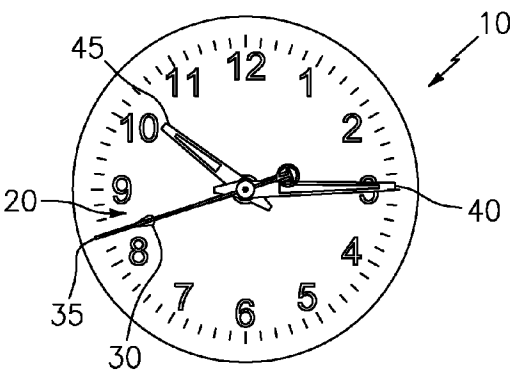

On the other hand, and also generally speaking, FIGS. 2 and 4 illustrate preferred methodologies in which the initiation of the chrono hand 30 results in the acceleration of seconds hand 35 (FIG. 2B, 4B) until the seconds hand 35 catches up to the position of the chrono hand 30 and they likewise coincide (FIG. 2C, 4C). Then, as long as the chrono hand 30 keeps running, the chrono hand 30 and the seconds hand 35 run together (FIG. 2D, 4D), likewise preferably one underneath the other, so that it appears as if there is only one hand rotating and displaying such elapsed time. Once the chrono hand 30 is stopped and, if desired, returned to a home position (e.g. FIG. 2E, 4E), the seconds hand 35 will either stop (i.e. to allow the actual time to "catch up" to where the seconds hand would have been had it not previously been accelerated (see generally FIG. 2)) or again run at a faster rotation rate until it has reached the correct position (see generally FIG. 4). Once in the correct (i.e. "accurate") position, it will resume running at the proper rate and displaying the proper TOD seconds (FIG. 2F, 4F).

Thus it can be seen that there are in effect four different methodologies achievable by the present invention. That is, as illustrated in FIG. 1, after starting the rotation of the chrono hand 30, there can be a stopping of the rotation of the seconds hand 35 until the two hands are coincident. Thereafter, and after stopping of the chrono hand, the seconds hand 35 can be (i) stopped or (ii) accelerated as discussed above. However, it should be understood that in the embodiment in which the seconds hand 35 is stopped for a second time, accurate timekeeping can be maintained only if the seconds hand 35 is not directly geared to minute hand 40 and hour hand 45, since in this example, twice stopping of the seconds hand 35 until it is accurately positioned, if coupled to minute hand 40 and hour hand 45, would result in minute hand 40 and hour hand 45 displaying time up to a minute behind the actual time.

Similarly, after starting the rotation of the chrono hand 30, there can be an acceleration of the rotation of the seconds hand 35 until the two hands are coincident as generally illustrated in FIG. 2. After stopping of the chrono hand 30, the seconds hand 35 can (i) again be accelerated to return the seconds hand 35 to the correct position or (ii) be stopped as discussed above. Here too, it should be understood that in the embodiment in which the seconds hand 35 is accelerated for a second time, accurate timekeeping can be maintained only if the seconds hand 35 is likewise not directly geared to minute hand 40 and hour hand 45, since in this example, twice accelerating the seconds hand 35 until it is accurately positioned, if coupled to minute hand 40 and hour hand 45, would result in minute hand 40 and hour hand 45 displaying time up to a minute ahead of the actual time.

While more will be discussed below with regard to these alternatives in which the seconds hand 35 is not geared to minute hand 40 and hour hand 45, reference is again made to FIGS. 1 and 2 for specifics of the preferred embodiments in which the seconds hand is in fact geared to minute hand 40 and hour hand 45 such that rotation of minute hand 40 and hour hand 45 is dependent on the rotation of the seconds hand 35.

Specifically, in the general embodiment of FIG. 1, it can be seen that there can be a display of elapsed time on display 20 of wristworn device 10, with at least one rotatable display (e.g. chrono) hand 30 for displaying elapsed time and a rotatable seconds hand 35 for displaying elapsed time (e.g. seconds) related to the time of day (TOD). As discussed above, rotation of the at least one display hand 30 can be initiated and terminated, such as by a pusher or actuation switch. It will be assumed that during this normal operating (e.g. a "first") mode, the seconds hand 35 is rotating about the display at a first rate, which in the preferred embodiment, is the TOD seconds hand rotation rate (e.g. 1 revolution per minute "rpm"), Here, and with reference to FIG. 1, a preferred method comprises the steps of starting the rotation of the at least one display hand 30 (FIG. 1B) when a user enters a time measuring mode (e.g. a chronograph mode) and then stopping the rotation of the seconds hand 35 until the at least one display hand 30 is at least essentially coincident with the seconds hand 35 (FIG. 1C). As shown in the Figures, FIG. 1A shows device 10 in the normal "run" mode, whereas FIG. 1B shows that the seconds hand 35, in the normal "run" mode, has advanced another three (3) seconds, at which time the user entered the time measuring mode and rotation of display hand 30 was initiated and the rotation of seconds hand 35 stops. By "coincident" it is meant that both hands 30, 35 occupy the same relative position, albeit essentially above (or below) each other, as the case may be. In the chronograph mode, the display hand 30 will preferably rotate at the first rate, i.e. 1 revolution per minute. Once coincident, the rotation of the seconds hand 35 is started again so that the seconds hand 35 and the at least one display hand 30 rotate together at the first rate, e.g. TOD seconds hand rotation rate (e.g. 1 rpm) and remain at least essentially coincident (FIG. 1D). At some point, the user may/will choose to stop the rotation of the at least one display (e.g. the "chrono") hand 30. In accordance with a preferred, but not necessary step, the chrono hand 30 may return to its home position (e.g. the 12 o'clock position, as shown in FIG. 1E). In any event, more importantly and in accordance with this preferred embodiment, thereafter, the seconds hand 35 will preferably rotate at a rate faster than the first (e.g. TOD seconds hand rotation) rate until the seconds hand 35 reaches a position at which the seconds hand 35 would have been had it not been stopped earlier. This "true up" position of the seconds hand is illustrated in FIG. 1E. To be sure, one skilled in the art could easily select a suitable accelerated rate of rotation, which could be by way of example and not limitation, 16 rpm or 32 rpm or faster, as battery and gear ratio constraints, as well as the desired (or acceptable) amount of time to reach the "true up" position, would be considered by the skilled device designer. It should also be understood that by accelerating the seconds hand 35 in this way, in an embodiment in which the seconds hand 35 gearing is coupled to minute hand 40 and hour hand 45 gearing, minute hand 40 and hour hand 45 will also accelerate to their respective correct and time-accurate positions.

Reference is now again made to the general embodiment of FIG. 2, where similarly there is a display of elapsed time on display 20 of wristworn device 10, with rotatable display (e.g. chrono) hand 30 for displaying elapsed time and rotatable seconds hand 35 for displaying elapsed time (e.g. seconds) related to the time of day (TOD). Likewise, rotation of display hand 30 can be initiated and terminated in any/all the manners disclosed above. In this embodiment as well, during the normal operating (e.g. "first") mode, the seconds hand 35 is rotating about the display at a first rate, which is preferably, but not necessarily the TOD seconds hand rotation rate (e.g. 1 rpm) (FIG. 2A).

Here, the method comprises the steps of starting the rotation of the at least one display hand 30 (FIG. 2B) when the chronograph mode is initiated, and then advancing the rotation of the seconds hand 35 at a rate faster than the first (e.g. TOD seconds hand rotation) rate (also shown in FIG. 2B) until the seconds hand 35 is at least essentially coincident with the at least one display hand 30 (FIG. 2C). The seconds hand 35 is then caused to return to rotate about the display at the TOD seconds hand rotation rate. In this way, the rotation of the seconds hand 35 is continued so that the seconds hand 35 and the at least one display hand 30 both rotate together at the TOD seconds hand sweep rate and remain at least essentially coincident (FIG. 2D). Again, by "coincident" it is meant that both hands 30, 35 occupy the same relative position, albeit essentially above (or below) each other, as the case may be, as the display hand 30 also preferably rotates at the first rate during the chronograph mode. As in the above embodiment, at some point, the user may/will choose to stop the rotation of the at least one display (e.g. "chrono") hand 30, and likewise, in accordance with a preferred, but non-necessary step, the chrono hand 30 may return to its home position (e.g. the 12 o'clock position, as shown in FIG. 2E). In any event, more importantly and in accordance with this preferred embodiment, thereafter, the rotation of the seconds hand 35 is stopped until the seconds hand 35 is positioned at which it would have been had it merely continued to rotate at the first rate and had not advanced at the rate faster than the first (e.g.) TOD seconds hand rotation rate. That is, the seconds hand 35 is stopped until it is positioned at which is displayed the accurate/true "seconds" position for the seconds hand 35. This may also be represented by the position of seconds hand 35 in FIG. 2E. The seconds hand 35 is then caused to begin rotating again about the display 20 at the first e.g. TOD seconds hand rotation rate, and the device 10 returns to its "normal run" mode, as illustrated in FIG. 2F. To be sure, in any/all of the foregoing examples, the display hand 30 may "return" to its home position at a rate faster than the TOD seconds hand rotation rate as would be understood and known in the art.

Also important to all the foregoing embodiments is the fact that the controller, as also discussed below, is able to maintain accurate control of where the seconds hand 35 should be positioned to display accurate seconds. That is, the controller must maintain and "know" the position to which it must return the seconds hand 35, whether by acceleration or otherwise, after termination of the chronograph mode. One skilled in the art would know how to achieve this objective.

Again, in this embodiment as well, one skilled in the art could easily select a suitable accelerated rate of rotation, which could be by way of example and not limitation, 16 rpm or 32 rpm or faster, as battery and gear ratio constraints, as well as the desired (or acceptable) amount of time to reach the coincident position, would be considered by the skilled device designer. It should also be understood that by stopping the seconds hand 35 in this way, the minute hand 40 and hour hand 45 will also be stopped until they too wait for the correct and accurate time to be displayed, at which point the seconds hand resumes rotation at its first (e.g. the TOD seconds hand rotation) rate.

The foregoing discloses the preferred methodologies in the embodiments in which the gearing for the seconds hand 35 is coupled to the gearing for the minute hand 40 and hour hand 45.

However, in the embodiments in which the gearing for the seconds hand 35 is not operatively coupled to gearing of minute hand 40 and hour hand 45, it is also possible for additional embodiments to be realized.

For example, as an alternative to the embodiment of FIG. 1 and as shown in FIG. 3, after the starting of the rotation of the at least one display hand 30 (FIG. 3B), the stopping of the rotation of the seconds hand 35 until the at least one display hand is at least essentially coincident with the seconds hand 35 (FIG. 3C) and the starting of the rotation of the seconds hand 35 so that the seconds hand 35 and the at least one display hand 30 rotate together at the first rate and remain at least essentially coincident (FIG. 3D), it is yet another preferred embodiment that after the stopping of the rotation of the at least one display hand 30, the rotation of the seconds hand 35 is again stopped (FIG. 3E) until the seconds hand 35 is at a position at which the seconds hand 35 would have been had it not been stopped the first time. That is, the seconds hand 35 is stopped until it is positioned at which is displayed the accurate/true seconds position for the seconds hand 35. Thereafter, the seconds hand will again be caused to rotate about the display at the first rate (FIG. 3F). It should be noted in this FIG. 3 embodiment that due to the independent stepping motor available for the TOD minute hand 40 and hour hand 45, hands 40, 45 can always continue to run accurately, no matter what the TOD seconds hand 35 and/or the chrono hand 30 are doing. For example, in comparing FIGS. 3B and 3C note the more obvious advancement of minute hand 40, notwithstanding the non-rotation of seconds hand 35.

Figure 4E:
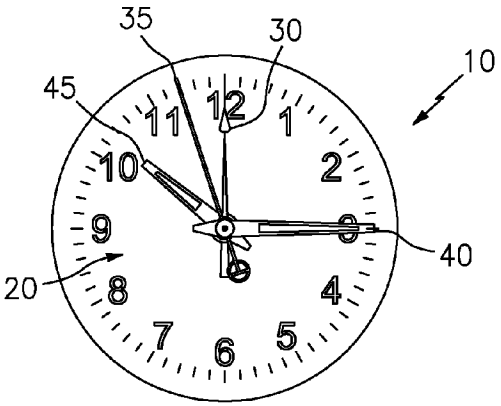
Figure 4F:
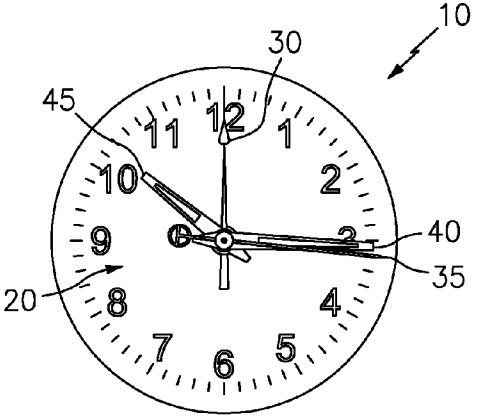

And, as an alternative to the embodiment of FIG. 2 and shown in FIG. 4, after the starting of the rotation of the at least one display hand 30 (FIG. 4B), the advancement of the rotation of the seconds hand 35 at a rate faster than the first rate (FIG. 4B) until the seconds hand 35 is at least essentially coincident with the at least one display hand 30 (FIG. 4C), and causing the seconds hand 35 to return to rotate about the display at the first (e.g. the TOD seconds hand rotation) rate such that the seconds hand 35 and the at least one display hand 30 continue to rotate together at the first rate and remain at least essentially coincident (FIG. 4D), it is yet another preferred embodiment that after stopping the rotation of the at least one display hand 30, the seconds hand 35 can again be rotated at a rate faster than the first rate (FIG. 4E) until the seconds hand 35 reaches a position at which the seconds hand would have been had it not accelerated the first time and had it merely and always simply been rotating at the first rate (FIG. 4E). Thereafter, the seconds hand 35 returns to rotate about the display at the first rate, as illustrated in FIG. 4F.

Here too it should be noted in this FIG. 4 embodiment that due to the independent stepping motor available for the TOD minute hand 40 and hour hand 45, hands 40, 45 can always continue to run accurately, no matter what the TOD seconds hand 35 and/or the chrono hand 30 are doing. For example, in comparing the figures within FIG. 4, note that minute hand 40 need not accelerate at all but can rotate both normally and accurately, notwithstanding the acceleration of seconds hand 35.

To be sure, in all instances in this disclosure, the preferred "first" rate is the TOD seconds hand rotation rate (i.e. 1 rpm).

As set forth above, the present invention is also directed to constructions of a wristworn device that carries out the foregoing methodologies and achieves the foregoing advantages and objectives. To this end, the present invention is also directed to the wristworn device and components thereof illustrated in FIGS. 5-7.

Figure 7:
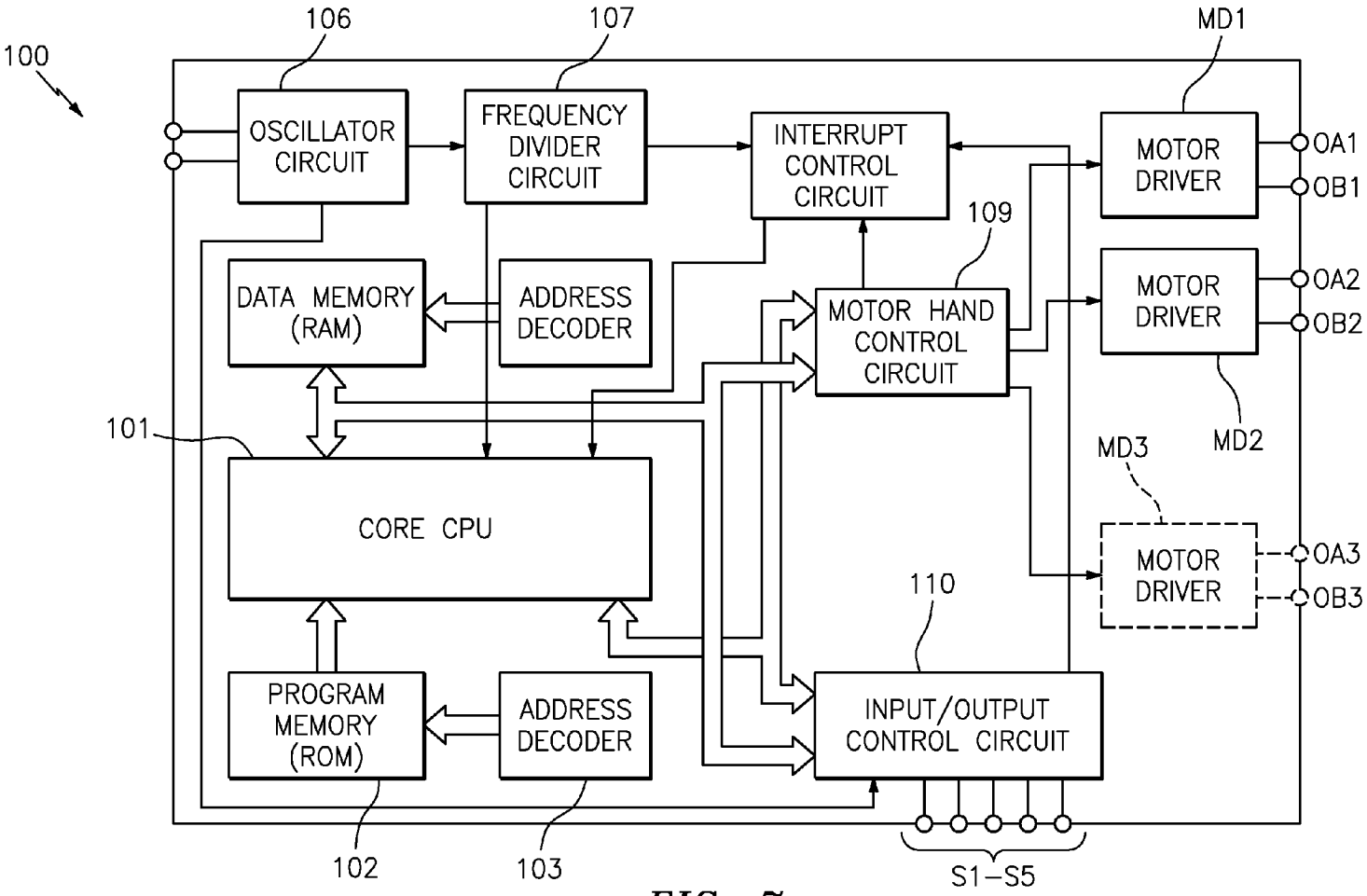
FIG. 7 is a block diagram of a controller, constructed in accordance with another preferred embodiment of the present invention, for use in a wristworn device constructed in accordance with the preferred embodiments of the present invention.

As discussed above, wristworn device 10 displays elapsed time on display 20, and comprises at least one rotatable display hand 30 for displaying the elapsed time and a rotatable seconds hand 35 for displaying elapsed time, e.g. seconds, related to the time of day (TOD) all as discussed above. Adding to such disclosure is, for example, FIG. 7, which is a block diagram of a controller 100 constructed in accordance with the present invention. For example, FIG. 7 illustrates a plurality of switches S1-S5 that comprise a switching arrangement for initiating and terminating a rotation of the at least one display hand 30. Switches S1-S5 are intended to generically indicate both side/top mounted pushers that respond to the actuation (i.e. pulling and/or pushing) thereof. Other types of switches, such as a rotating crown or the like, are also contemplated herein. Likewise, a single switch may be used for both initiation and terminating the rotation of the at least one display hand 30 or different switches can be used for initiating and termination, respectively, all of which would be understood by those skilled in the art. Details of such pushers or other actuations are not material to the present invention, and therefore disclosure thereof is omitted for brevity.

Details of controller 100 not material to the present invention can be found for example in U.S. Pat. No. 7,113,450, the subject matter of which is incorporated by reference as if fully set forth herein. In accordance with the preferred embodiments herein, the controller 100 is operatively coupled to the switching arrangement, and provides the functionality for initiating the rotation of the at least one display hand 30; stopping the rotation of the seconds hand 35 until the at least one display hand 30 is at least essentially coincident with the seconds hand 35; starting the rotation of the seconds hand 35 so that the seconds hand 35 and the at least one display hand 30 rotate together at the TOD seconds hand rotation rate and remain at least essentially coincident; terminating the rotation of the at least one display hand 30; and thereafter, causing the rotating of the seconds hand 35 at a rate faster than the TOD seconds hand rotation rate until the seconds hand 35 reaches a position at which the seconds hand 35 would have been had it not been stopped; and then causing the seconds hand 35 to rotate about the display at the TOD seconds hand rotation rate.

In accordance with the embodiment illustrated and discussed above with respect to FIG. 2, controller 100 is likewise operatively coupled to the switching arrangement, and provides the functionality for initiating the rotation of the at least one display hand 30; causing the rotating of the seconds hand 35 at a rate faster than the TOD seconds hand rotation rate until the seconds hand 35 is at least essentially coincident with the at least one display hand 30, and then causing the seconds hand to return to rotate about the display at the TOD seconds hand rotation rate; providing for the continued rotation of the seconds hand 35 so that the seconds hand 35 and the at least one display hand 30 rotate together at the TOD seconds hand rotation rate and remain at least essentially coincident; terminating the rotation of the at least one display hand 30; and thereafter, stopping the rotation of the seconds hand 35 until the seconds hand 35 is at a position at which the seconds hand 35 would have been had it not advanced at the rate faster than the TOD seconds hand rotation rate; and then causing the seconds hand 35 to rotate about the display at the TOD seconds hand rotation rate. To be sure, the wristworn devices disclosed herein carry out the methodologies disclosed above.

Moreover, each of the aforementioned embodiments of wristworn device 10 preferably has the gearing of the seconds hand 35 operatively coupled to the gearing of the minute hand 40 and hour hand 45.

That is, in the embodiments in which the seconds hand 35 need not be operatively coupled to the gearing of minute hand 40 and hour hand 45, the present invention also contemplates embodiments in which:

a) after starting of the rotation of the at least one display hand 30, stopping of the rotation of the seconds hand 35 until the at least one display hand 30 is at least essentially coincident with the seconds hand 35 and starting of the rotation of the seconds hand 35 again so that the seconds hand 35 and the at least one display hand 30 rotate together at the first rate and remain at least essentially coincident, it is yet another preferred embodiment that after the stopping of the rotation of the at least one display hand 30 by the actuation of the switching mechanism, the controller 100 causes the rotation of the seconds hand 35 to again stop until the seconds hand 35 is at a position at which the seconds hand 35 would have been had it not been stopped the first time and had merely continued rotating at the first rate. Thereafter, controller 100 causes the seconds hand 35 to again rotate about the display at the first rate; and b) after starting of the rotation of the at least one display hand 30, advancing the rotation of the seconds hand 35 at a rate faster than the first rate until the seconds hand 35 is at least essentially coincident with the at least one display hand 30, and causing the seconds hand 35 to return to rotate about the display at the first (e.g. the TOD seconds hand rotation) rate such that the seconds hand 35 and the at least one display hand 30 continue to rotate together at the first rate and remain at least essentially coincident, it is yet another preferred embodiment that after stopping the rotation of the at least one display hand 30 by actuation of the switching mechanism, the controller 100 causes the seconds hand 35 to again be rotated at a rate faster than the first rate until the seconds hand 35 reaches a position at which the seconds hand would have been had it not accelerated the first time, all as disclosed above. Thereafter, controller 100 causes the seconds hand 35 to return to rotate about the display at the first rate. Again, the preferred "first" rate is the TOD seconds hand rotation rate (i.e. 1 rpm) and the preferred exemplary "rate faster than the first rate" is 16 rpm or 32 rpm or faster.

Figure 5:
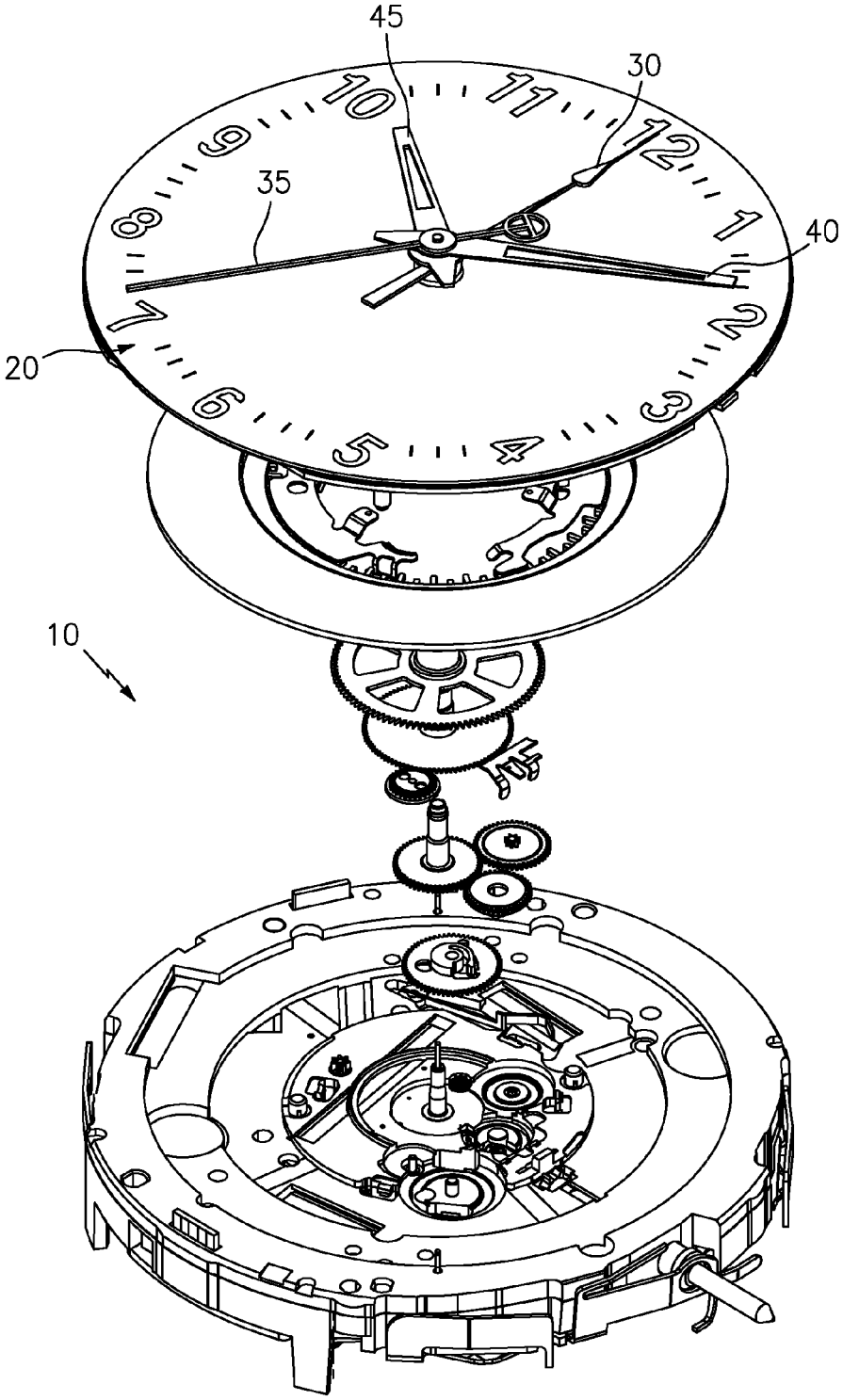
FIG. 5 is an exploded view of a wristworn device constructed in accordance with another preferred embodiment of the present invention.
Figure 6:
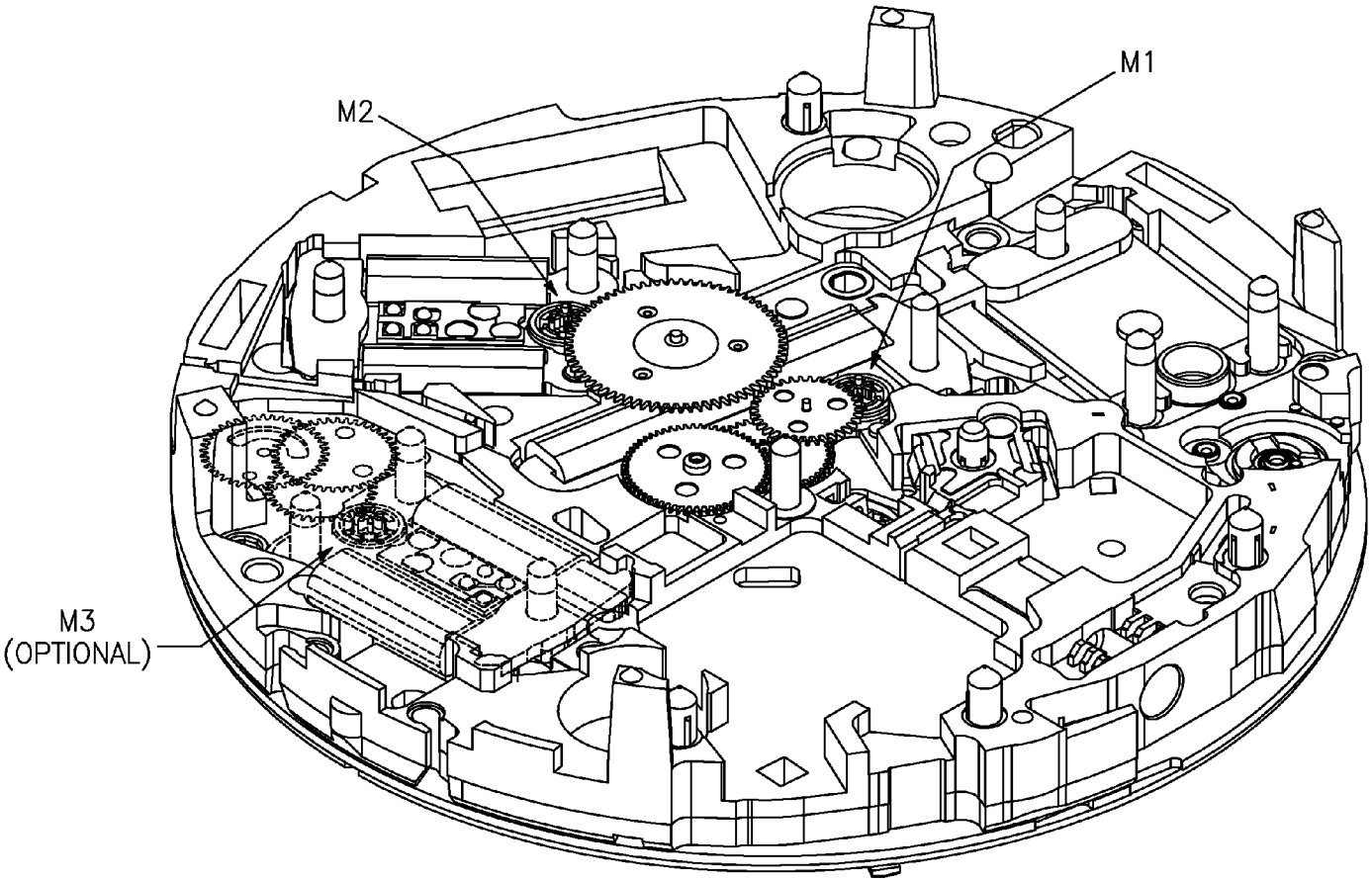
FIG. 6 is a perspective view of the movement side of the wristworn device of FIG. 5.

In accordance for ensuring a full disclosure of the present invention, FIG. 5 illustrates an exploded view of wristworn device 10, constructed in accordance with the present invention. In the preferred construction wristworn device 10 is a timepiece, such as a wristwatch. As alluded to above, in a preferred embodiment, FIGS. 5 and 6 together illustrate a preferred embodiment in which seconds hand 35, minute hand 40 and hour hand 45 are all operatively coupled together such that rotation of the seconds hand 35 is necessary to rotate minute hand 40 and hour hand 45 during normal operation. FIG. 5 also illustrates chrono hand 30. The gearing and motors associated therewith are illustrated in FIGS. 5 and 6. Specifically, motor M1 is provided for rotating seconds hand 35, minute hand 40 and hour hand 45 and motor M2 is provided for rotating chrono hand 30. A plurality of gears are associated with each, are generally illustrated in FIG. 6, and would be well understood by those skilled in the art. Motor M1 is preferably a uni-directional stepper motor, whereas motor M2 is preferably a bi-directional stepper motor thus being able to rotate in either direction. A motor M3 is shown in dotted lines in FIG. 6 and would be implemented if seconds hand 35 was not geared to minute hand 40 and hour hand 45 as disclosed herein and as would be understood in the art.

FIG. 7 generally illustrates controller 100, which is preferably an integrated microcontroller typically used with electronic devices such as timepieces. In a preferred embodiment, controller 100 comprises a core CPU 101 which itself comprises an ALU, a calculation register, a stack pointer, an instruction register and an instruction decoder. Controller 100 utilizes a memory mapped I/O bus to communicate with hand control circuit 109 and input output control circuit 110 as would be understood by those skilled in the art. A ROM memory block 102 in cooperation with an address encoder 103 provides access to electronic device control software and fixed data. The methodology for the programming for directing CPU 101 on the steps and logic necessary to keep track of and determine subsequent motor positions, as would be understood in the art, is also coded into ROM 102. Driving and controlling stepper motors M1 and M2 utilizing motor drivers MD1, MD2, respectively, is also well known in the art. In the event the embodiments are such that seconds hand 35 is not geared to minute hand 40 and hour hand 45, an additional motor driver MD3 is illustrated and can be utilized to drive motor M3 as would be understood in the art.

Other aspects of controller 100, such as the functionality of oscillator circuit 106, frequency divider circuit 107 and their respective functionality for generating appropriate timing signals for timekeeping, motor control and data acquisition functions, would also be understood by one of ordinary skill in the art. A motor hand control circuit 109 receives a commanded "next number of pulses" from CPU core 101 and generates the pulsed and phased signals necessary to move a desired motor (e.g. M1, M2) a desired amount and in a desired direction. Pulse outputs of the motor hand control circuit 109 are buffered by the motor drivers and applied to the respective motors. An input/output control circuit 110 controls the push-button switches (e.g. switching mechanism) and provides such signaling information to CPU 101. Other features are also shown in FIG. 7, but all of which would be understood by those skilled in the art. In this way, all of the needed functionality to carry out the preferred embodiments of the present invention is disclosed.

As can be seen from the foregoing as well as the figures, the present invention provides for improvements over the prior art in that the present invention provides improved methods and constructions to reduce the likelihood of misinterpretation, error and/or confusion in reading and interpreting elapsed time on a wristworn display, such as a timepiece.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall therebetween.

What is claimed is:

1. A method of displaying elapsed time on a display of a wristworn device, wherein the wristworn device comprises said display, at least one rotatable display hand for displaying elapsed time, a rotatable seconds hand for displaying elapsed time related to the time of day (TOD), and wherein rotation of the at least one display hand can be initiated and terminated, and wherein during a first mode the seconds hand is rotating about the display at a first rate, the method comprises the steps of:

starting the rotation of the at least one display hand;

stopping the rotation of the seconds hand until the at least one display hand is at least essentially coincident with the seconds hand;

starting the rotation of the seconds hand so that the seconds hand and the at least one display hand rotate together at the first rate and remain at least essentially coincident;

stopping the rotation of the at least one display hand; and thereafter, rotating the seconds hand at a rate faster than the first rate until the seconds hand reaches a position at which the seconds hand would have been had it not been stopped; and then causing the seconds hand to rotate about the display at the first rate.

2. The method as claimed in claim 1, wherein:

the first mode is the normal "run" mode;

the at least one display hand is started when the wristworn device enters a "chrono" mode;

the seconds hand displays elapsed seconds; and the first rate is a TOD seconds hand rotation rate.

3. A wristworn device that displays elapsed time on a display, wherein the wristworn device comprises:

at least one rotatable display hand for displaying the elapsed time;

a rotatable seconds hand for displaying elapsed seconds related to the time of day (TOD), a switching arrangement for initiating and terminating a rotation of the at least one display hand; and a controller, operatively coupled to the switching arrangement, for carrying out the methodology as claimed in claim 1.

4. A method of displaying elapsed time on a display of a wristworn device, wherein the wristworn device comprises said display, at least one rotatable display hand for displaying elapsed time, a rotatable seconds hand for displaying elapsed time related to the time of day (TOD), and wherein rotation of the at least one display hand can be initiated and terminated, and wherein during a first mode the seconds hand is rotating about the display at a first rate, the method comprises the steps of:

starting the rotation of the at least one display hand;

advancing the rotation of the seconds hand at a rate faster than the first rate until the seconds hand is at least essentially coincident with the at least one display hand, and then causing the seconds hand to return to rotate about the display at the first rate;

continuing the rotation of the seconds hand so that the seconds hand and the at least one display hand rotate together at the first rate and remain at least essentially coincident;

stopping the rotation of the at least one display hand; and stopping the rotation of the seconds hand until the seconds hand is at a position at which the seconds hand would have been had it not advanced at the rate faster than the first rate; and then causing the seconds hand to rotate about the display at the first rate.

5. The method as claimed in claim 1, wherein:

the first mode is the normal "run" mode;

the at least one display hand is started when the wristworn device enters a "chrono" mode;

the seconds hand displays elapsed seconds; and the first rate is a TOD seconds hand rotation rate.

6. A wristworn device that displays elapsed time on a display, wherein the wristworn device comprises:

at least one rotatable display hand for displaying the elapsed time;

a rotatable seconds hand for displaying elapsed seconds related to the time of day (TOD), a switching arrangement for initiating and terminating a rotation of the at least one display hand; and a controller, operatively coupled to the switching arrangement, for carrying out the methodology as claimed in claim 4.

7. A wristworn device that displays elapsed time on a display, wherein the wristworn device comprises:

at least one rotatable display hand for displaying the elapsed time;

a rotatable seconds hand for displaying elapsed seconds related to the time of day (TOD), wherein during a first mode, the seconds hand rotates about the display at a TOD seconds hand rotation rate;

a switching arrangement for initiating and terminating a rotation of the at least one display hand; and a controller, operatively coupled to the switching arrangement, for:

initiating the rotation of the at least one display hand;

stopping the rotation of the seconds hand until the at least one display hand is at least essentially coincident with the seconds hand;

starting the rotation of the seconds hand so that the seconds hand and the at least one display hand rotate together at the TOD seconds hand rotation rate and remain at least essentially coincident;

terminating the rotation of the at least one display hand; and thereafter, causing the rotating of the seconds hand at a rate faster than the TOD seconds hand rotation rate until the seconds hand reaches a position at which the seconds hand would have been had it not been stopped; and then causing the seconds hand to rotate about the display at the TOD seconds hand rotation rate.

8. A wristworn device that displays elapsed time on a display, wherein the wristworn device comprises:

at least one rotatable display hand for displaying elapsed time;

a rotatable seconds hand for displaying elapsed seconds related to the time of day (TOD), wherein during a first mode, the seconds hand rotates about the display at a TOD seconds hand rotation rate;

a switching arrangement for initiating and terminating a rotation of the at least one display hand; and a controller, operatively coupled to the switching arrangement, for:

initiating the rotation of the at least one display hand;

causing the rotating of the seconds hand at a rate faster than the TOD seconds hand rotation rate until the seconds hand is at least essentially coincident with the at least one display hand, and then causing the seconds hand to return to rotate about the display at the TOD seconds hand rotation rate;

providing for the continued rotation of the seconds hand so that the seconds hand and the at least one display hand rotate together at the TOD seconds hand rotation rate and remain at least essentially coincident;

terminating the rotation of the at least one display hand; and stopping the rotation of the seconds hand until the seconds hand is at a position at which the seconds hand would have been had it not advanced at the rate faster than the TOD seconds hand rotation rate; and then causing the seconds hand to rotate about the display at the TOD seconds hand rotation rate.

* * * * *